US005222262A

United States Patent [19]

Boyd

[11] Patent Number: 5,222,262

[45] Date of Patent: Jun. 29, 1993

[54] WATERBED MATTRESS WITH BAFFLES

[76] Inventor: Dennis Boyd, 14457 Rouge River, Chesterfield, Mo. 63017

[21] Appl. No.: 761,518

[22] Filed: Sep. 18, 1991

[51] Int. Cl.[5] ..... A47C 27/08

[52] U.S. Cl. ..... 5/451; 5/919; 5/920; 5/921

[58] Field of Search ..... 5/451, 450, 457, 452, 5/422, 919–921

[56] References Cited

U.S. PATENT DOCUMENTS

| | | | |
|---|---|---|---|
| 4,280,235 | 7/1981 | Kowal | 5/451 |
| 4,329,748 | 5/1982 | Finkelstein | 5/451 |
| 4,399,575 | 8/1983 | Hall | 5/450 |
| 4,551,873 | 11/1985 | Hall | 5/450 |
| 4,656,681 | 4/1987 | Alexander et al. | 5/451 |
| 4,751,757 | 6/1988 | Moreno | 5/450 |
| 4,901,386 | 2/1990 | Lane | 5/450 |
| 4,905,331 | 3/1990 | Hochschild, III | 5/450 |
| 5,001,792 | 3/1991 | Strobel | 5/451 |

*Primary Examiner*—Alexander Grosz
*Attorney, Agent, or Firm*—Polster, Lieder, Woodruff & Lucchesi

[57] ABSTRACT

A waterbed mattress includes a watertight envelope having a top, a bottom, and sides, which envelope defines a cavity for water. Anti-wave material such as fiber or foam, or anti-wave structure such as hydraulic inserts, is disposed inside the watertight envelope. The anti-wave material or structure is secured to the top of the watertight envelope by a plurality of seals and is in fluid communication with the water cavity. The plurality of seals form a pattern which is visible from the exterior of the waterbed mattress. This gives the appearance of a quilted top to the mattress when fiber or foam is secured to the top of the envelope by the seals. In some embodiments, a lumbar support is included.

12 Claims, 2 Drawing Sheets

WATERBED MATTRESS WITH BAFFLES

BACKGROUND OF THE INVENTION

This invention relates to waterbeds and more particularly to waterbed mattresses with wave dampening structures.

Waterbed mattresses are available with wave dampening structures which serve to reduce any wave motions along the top surface of the mattress. Such structures include fiber or foam batts and hydraulic inserts. These adequately suppress wave motion, but they could be improved.

For example, these wave dampening structures are typically denser than water, and thus require buoyancy or flotation devices to properly position them adjacent the top surface of the waterbed mattress. If the wave dampening structure remains on the bottom of the mattress, it not only fails to properly suppress wave motion along the top of the mattress, but also obstructs the transfer of heat from the heater (disposed underneath the mattress) to the water in the mattress. This can result in excessive heat build-up along the bottom of the mattress.

Even with flotation devices, present wave dampening structures can shift position or even "flip" over. This movement can render the anti-wave structure useless.

Present mattresses also sometimes require special knowledge with respect to setting up the mattress properly so that the wave dampening structure functions adequately. As a result, the ordinary consumer is sometimes unable to move his or her own waterbed without affecting its wave dampening capabilities.

It is also becoming increasingly desirable that the upper surface of the waterbed mattress have an attractive appearance. Presently, most waterbed mattresses have a smooth upper surface, although recently mattresses with a "quilted" look similar to conventional mattresses have become available. It is felt that the "quilted" look is preferred by consumers, so long as that look does not interfere with the operation of the waterbed mattress itself.

SUMMARY OF THE INVENTION

Among the various objects and features of the present invention may be noted the provision of a waterbed mattress which eliminates the need for buoyancy material.

Another object is the provision of such a waterbed mattress which ensures proper placement of the wave dampening structure.

A third object is the provision of such a waterbed mattress which eliminates the concentration of heat along the bottom of the mattress.

A fourth object is the provision of such a waterbed mattress which eliminates the tendency of the wave dampening structure to shift.

A fifth object is the provision of such a waterbed mattress which has a pleasing appearance.

A sixth object is the provision of such a waterbed mattress which may be moved by the consumer without affecting the wave dampening structure.

A seventh object is the provision of such a waterbed mattress which is relatively simple in construction.

Other objects and features will be in part apparent and in part pointed out hereinafter.

Briefly, in a first aspect of the present invention, a waterbed mattress includes a watertight envelope having a top, a bottom, and sides, which envelope defines a cavity for water in the waterbed mattress. Anti-wave material is disposed inside the watertight envelope and is secured to the top of the watertight envelope. The anti-wave material is also in fluid communication with the water cavity.

In a second aspect of the present invention a waterbed mattress includes a watertight envelope having a top, a bottom, and sides, which envelope defines a cavity for water in the waterbed mattress. Anti-wave material is disposed inside the watertight envelope and is secured to the top of the watertight envelope by a plurality of seals. The plurality of seals forms a pattern visible from the exterior of the waterbed mattress. The anti-wave material is in fluid communication with the water cavity.

In a third aspect of the present invention, a waterbed mattress includes a watertight envelope having a top, a bottom, and sides, which envelope defines a cavity for water in the waterbed mattress. Anti-wave material is disposed inside the watertight envelope and a layer of vinyl is disposed below at least some of the anti-wave material. The vinyl layer and the anti-wave material are secured to the top of the watertight envelop by a plurality of seals. At least a portion of the anti-wave material disposed above the vinyl layer is in fluid communication with the water cavity.

In a fourth aspect of the present invention, a waterbed mattress includes a watertight envelope having a top, a bottom, and sides, which envelope defines a cavity for water in the waterbed mattress. Anti-wave structure is disposed inside the watertight envelope for damping the propagation of waves inside the water cavity. The anti-wave structure is secured to the top of the watertight envelope by a plurality of seals.

BRIEF DESCRIPTION OF THE DRAWINGS

Similar reference characters indicate similar parts throughout the several views of the drawings.

DESCRIPTION OF THE PREFERRED EMBODIMENT

Figure 1:
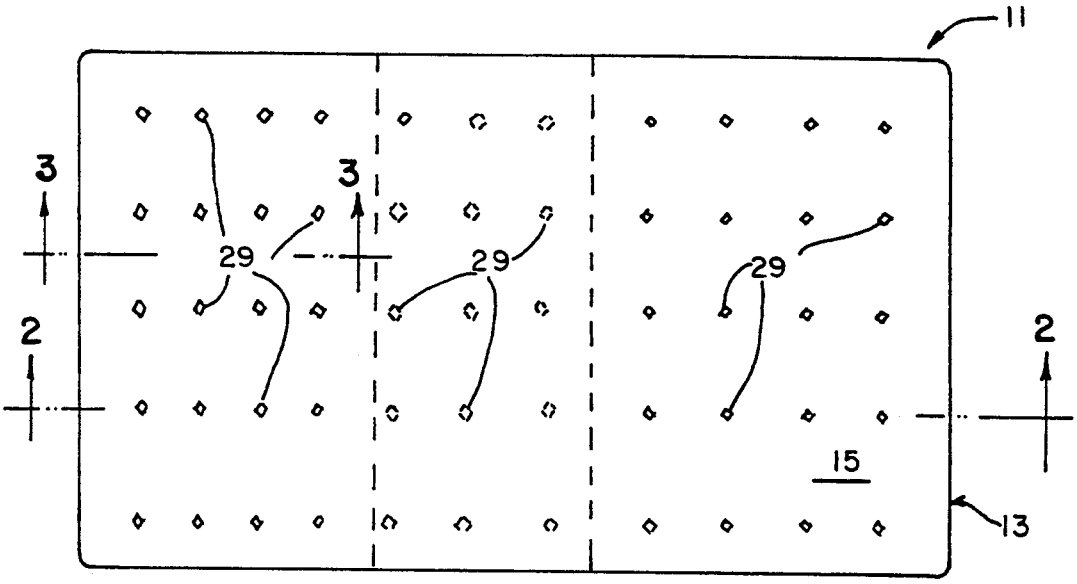
FIG. 1 is a top plan of a first embodiment of the waterbed mattress of the present invention.
Figure 2:
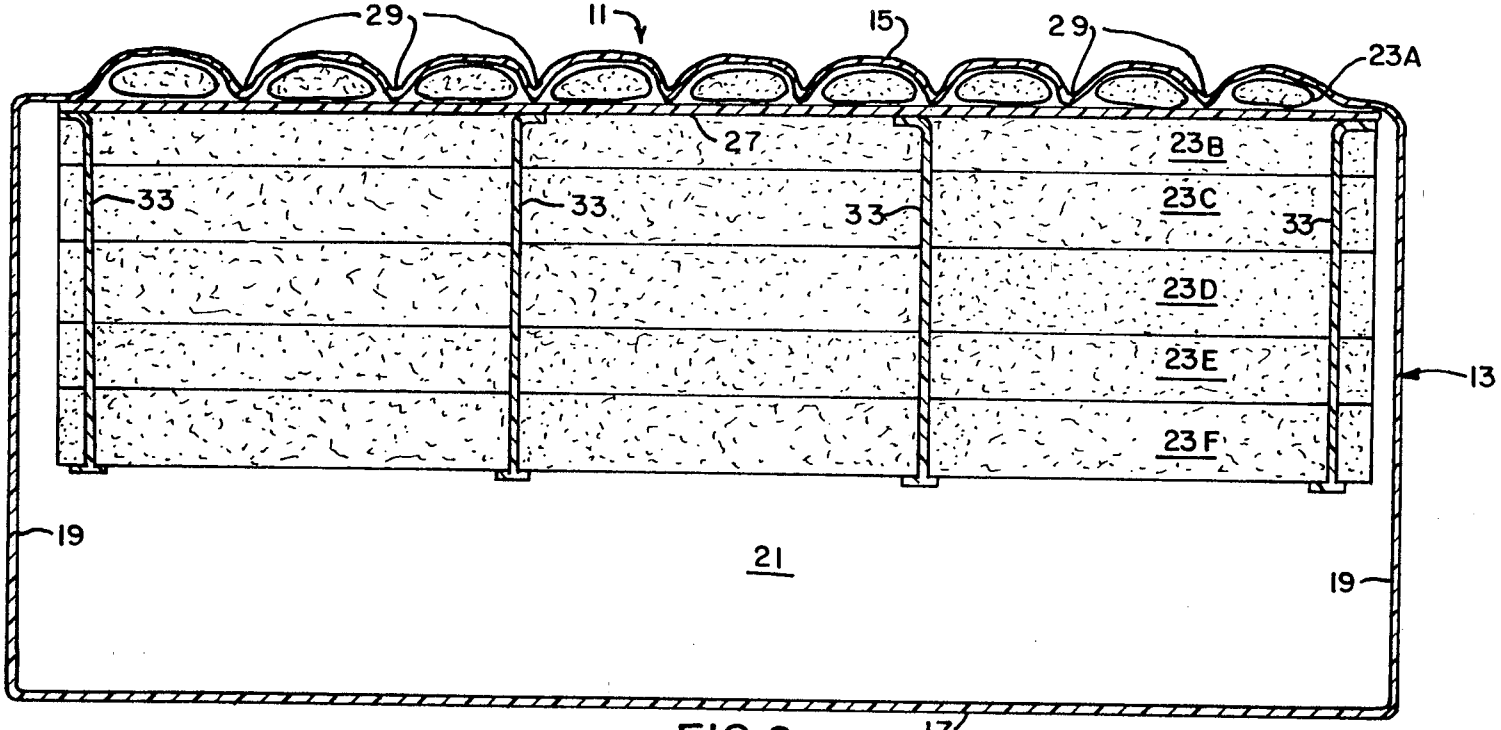
FIG. 2 is a cross-sectional view, taken along lines 2—2 of FIG. 1.
Figure 3:
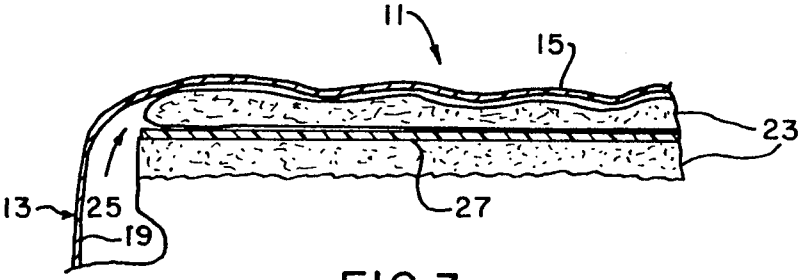
FIG. 3 is a partial section, taken along lines 3—3 of FIG. 1.

Turning to the drawings and particularly to FIGS. 1-3, a waterbed mattress 11 of the present invention includes a watertight envelope 13 having a top 15, a bottom 17 (shown in FIG. 2 only), and sides 19 (see FIGS. 2 and 3). Envelope 13 is made of a suitable material such as vinyl and defines a cavity 21 (see FIG. 2) for water in waterbed mattress 11.

Waterbed mattress 11 includes anti-wave material 23 (see FIGS. 2 and 3) disposed inside the watertight envelope in fluid communication with the water cavity 21 (as shown by the arrow 25 in FIG. 3). Specifically, the anti-wave material (which may be any suitable fiber or foam) is preferably disposed in a plurality of layers (labelled 23A–23F in FIG. 2) secured to a vinyl layer 27. Vinyl layer 27 is secured by radio frequency sealing or the like to top 15 of the mattress. The result is a plurality of depressed seals 29 which form a pattern visible from the exterior of the mattress. A few of the seals 29 are labelled in FIGS. 1 and 2.

Because the top layer of anti-wave material 23A is relatively thin and compressible, the sealing of vinyl layer 27 to mattress top 15 separates the top layer of anti-wave material at the locations of the seals (see FIG. 2). Note from FIG. 3, however, that the top layer of anti-wave material is not separated at those locations away from the seals. This gives the top 15 of mattress 11 a soft, pillow-like or quilted appearance.

In addition to providing a pleasing appearance, this construction secures the anti-wave material 23 to the top of the watertight envelope. Since the topmost layer of the anti-wave material is in fluid communication with the water in cavity 21 (see FIG. 3), the anti-wave material secured to mattress top 15 still performs its anti-wave function.

Anti-wave material 23 is typically denser than water, so if the top layer 23A were not secured to mattress top 15 that layer would simply fall to the bottom of the waterbed mattress. Moreover, the present construction also holds the anti-wave material securely in place inside the mattress. Being secured directly to the top of the mattress, it is impossible for the anti-wave material to flip or otherwise shift inside the mattress.

As shown in FIG. 2, even if more than one layer of anti-wave material is used, all the layers of anti-wave material remain in fluid communication with the water in cavity 21. Each layer is attached to some suitable securing device, such as the vinyl strips 33 shown in FIG. 2, which are in turn secured to vinyl layer 27 (and thereby secured to mattress top 15). Alternatively, rivets, nylon thread, and other suitable securing devices may be used to secure vinyl layer 27 to the top of the mattress. Of course, the number of securing devices 27 used depends upon the weight of the anti-wave material being secured and the like.

Figure 4:
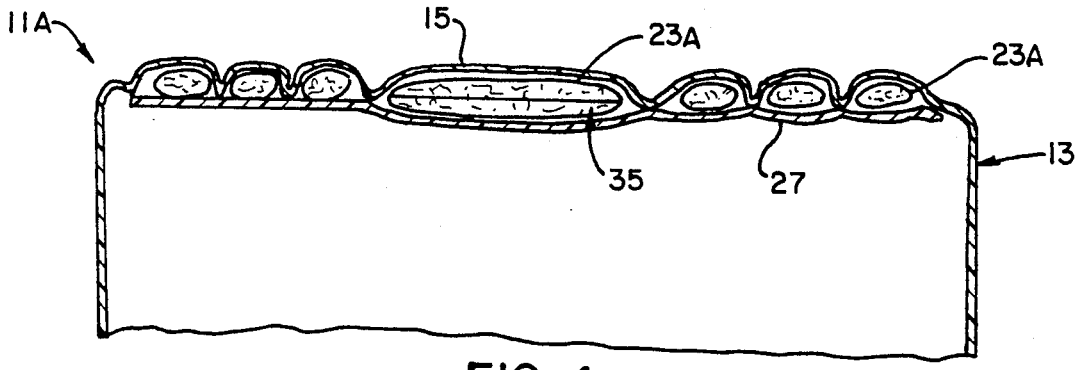
FIG. 4 is a sectional view, similar to FIG. 2, illustrating an alternative embodiment of the waterbed mattress of the present invention.
Figure 5:
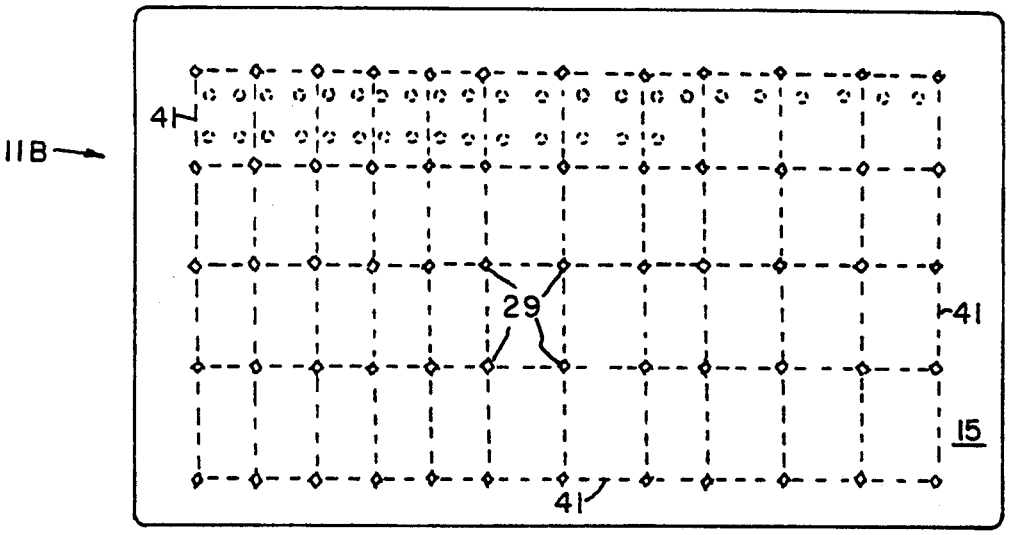
FIG. 5 is a top plan of another embodiment of the waterbed mattress of the present invention.
Figure 6:
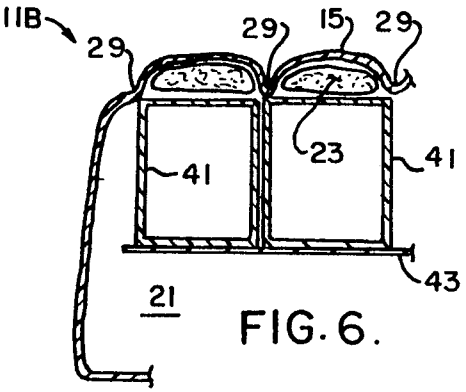
FIG. 6 is a partial section of the waterbed mattress of FIG. 5.

Turning to FIG. 4, there is shown an alternative mattress 11A in which an additional layer 35 of anti-wave material is disposed between mattress top 15 and vinyl layer 27. This layer 35 extends across the mattress in the area delineated by the dashed lines in FIG. 1 and provides additional lumbar support for the user. As a result of the presence of additional layer 35, the anti-wave material has substantially a first thickness throughout a majority of its extent and a second, greater thickness in an area corresponding to the lumbar support area of the waterbed mattress. With the embodiment of FIG. 4, seals 29 are not necessarily present in the lumbar support area. This is indicated in FIG. 1 by showing the seals with dashed lines Yet another embodiment of the waterbed mattress of the present invention, labelled 11B, is shown in FIGS. 5 and 6. Waterbed mattress 11B instead of having anti-wave material 23 includes anti-wave structure 41 disposed inside the water cavity for damping the propagation of waves. This structure is shown, for purposes of illustration, as a plurality of hydraulic inserts, each having a plurality of openings in its top surface. The inserts operate in the conventional manner. However, their method of securement to the water mattress is unconventional Each hydraulic insert 41 is secured at its top corners to mattress top 15. This construction positions the hydraulic inserts at the top of the water cavity 21, where they are most useful. It eliminates the need for any flotation device, which are required in previous water mattresses using hydraulic inserts. And it prevents the hydraulic inserts from flipping or shifting inside the mattress.

Optionally, a layer of fiber or foam 23 may be secured between the hydraulic inserts and mattress top 15 to provide the desirable quilted look and feel to mattress 11B. Fiber or resilient foam layer 23 is held in place by the plurality of seals 29 between the inserts and the top of the envelope.

To further improve the operation of water mattress 11B, a vinyl sink sheet 43 may be secured to the bottoms of the hydraulic inserts. This causes the hydraulic inserts to open sooner as the water mattress is filled with water. Alternatively, a fiber layer could be used to serve as a sink sheet.

In view of the above, it will be seen that the various objects and features of the present invention are achieved and other advantageous results obtained. The embodiments and the drawings of the invention disclosed herein are illustrative only and are not to be taken in a limiting sense.

What is claimed is:

1. A waterbed mattress comprising:

a watertight envelope having a top, a bottom, and sides, said envelope defining a cavity for water in the waterbed mattress;

anti-wave material disposed inside the watertight envelope, said anti-wave material being disposed in a plurality of discrete layers;

a layer of vinyl disposed inside the watertight envelope, said vinyl layer corresponding generally in size and shape to the top of the envelope, said vinyl layer being secured to the top of the envelope by a plurality of seals;

a plurality of straps secured to and depending from said vinyl layers, at least some of said straps extending through a plurality of layers of anti-wave material;

said anti-wave material being secured to the top of the watertight envelope by means of said straps and said vinyl layer.

2. The waterbed mattress as set forth in claim 1 wherein the anti-wave material is denser than water.

3. The waterbed mattress as set forth in claim 1 wherein the anti-wave material includes a plurality of layers of fiber.

4. The waterbed mattress as set forth in claim 1 wherein the anti-wave material includes a plurality of layers of resilient foam.

5. The waterbed mattress as set forth in claim 1 wherein the top of the envelope is depressed at those spots where the seals are disposed.

6. A waterbed mattress comprising:

a watertight envelope having a top, a bottom, and sides, said envelope defining a cavity for water in the waterbed mattress;

anti-wave material disposed inside the watertight envelope;

said anti-wave material being secured to the top of the watertight envelope by a plurality of seals forming a pattern visible from the exterior of the waterbed mattress, said top of the envelope being depressed at those spots where the seals are disposed, said anti-wave material being in fluid communication with the water cavity;

said anti-wave material secured to the top of the envelope being disposed at least partially above the level of the seals to provide a quilted appearance to the exterior of the top of the envelope.

7. A waterbed mattress comprising:

a watertight envelope having a top, a bottom, and sides, said envelope defining a cavity for water in the waterbed mattress;

anti-wave material disposed inside the watertight envelope;

said anti-wave material being secured to the top of the watertight envelope by a plurality of seals, the top of the envelope being depressed at those spots where the seals are disposed so that said plurality of seals forms a pattern visible from the exterior of the waterbed mattress;

said anti-wave material being in fluid communication with the water cavity;

said anti-wave material secured to the top of the envelope being disposed at least partially above the level of the seals to provide a quilted appearance to the exterior of the top of the envelope.

8. A waterbed mattress comprising:

a watertight envelope having a top, a bottom, and sides, said envelope defining a cavity for water in the waterbed mattress;

anti-wave material disposed inside the watertight envelope;

a layer of vinyl disposed below at least some of the anti-wave material;

said vinyl layer and said anti-wave material being secured to the top of the watertight envelope by a plurality of seals;

at least a portion of the anti-wave material disposed above the vinyl layer being in fluid communication with the water cavity;

the top of the envelope being depressed at those spots where the seals are disposed.

9. The waterbed mattress as set forth in claim 8 wherein the anti-wave material secured to the top of the envelope is disposed at least partially above the level of the seals to provide a quilted appearance to the exterior of the top of the envelope.

10. A waterbed mattress comprising:

a watertight envelope having a top, a bottom, and sides, said envelope defining a cavity for water in the waterbed mattress;

anti-wave means disposed inside the watertight envelope for damping the propagation of waves inside the water cavity, said anti-wave means including a plurality of hydraulic inserts disposed inside the watertight envelope;

said anti-wave means being secured to the top of the watertight envelope by a plurality of seals; and a layer of fiber disposed between the hydraulic inserts and the top of the envelope, said fiber layer being held in place by the plurality of seals between the inserts and the top of the envelope.

11. A waterbed mattress comprising:

a watertight envelope having a top, a bottom, and sides, said envelope defining a cavity for water in the waterbed mattress;

anti-wave means disposed inside the watertight envelope for damping the propagation of waves inside the water cavity, said anti-wave means including a plurality of hydraulic inserts disposed inside the watertight envelope;

said anti-wave means being secured to the top of the watertight envelope by a plurality of seals; and a layer of resilient foam disposed between the hydraulic inserts and the top of the envelope, said foam layer being held in place by the plurality of seals between the inserts and the top of the envelope.

12. A waterbed mattress comprising:

a watertight envelope having a top, a bottom, and sides, said envelope defining a cavity for water in the waterbed mattress;

anti-wave means disposed inside the watertight envelope for damping the propagation of waves inside the water cavity;

said anti-wave means being secured to the top of the watertight envelope by a plurality of seals, said seals forming a pattern visible from the exterior of the waterbed mattress and said top of the envelope being depressed at those spots where the seals are disposed;

the anti-wave material secured to the top of the envelope being disposed at least partially above the level of the seals to provide a quilted appearance to the exterior of the top of the envelope.

* * * * *